US005253557A

United States Patent [19]

Dolak

[11] Patent Number: 5,253,557

[45] Date of Patent: Oct. 19, 1993

[54] ERGONOMIC HANDLE CONSTRUCTION FOR HAND-HELD TOOLS

[75] Inventor: David E. Dolak, Columbia, S.C.

[73] Assignee: The Triangle Tool Group, Inc. a subsidiary of The Triangle Corporation, Stamford, Conn.

[21] Appl. No.: 974,927

[22] Filed: Nov. 12, 1992

[51] Int. Cl.[5] ..... B25B 7/00

[52] U.S. Cl. ..... 81/427.5; 81/177.2; 30/340; 16/115; 16/116 R

[58] Field of Search ..... 81/177.2, 415, 427.5, 81/489; 30/340; 16/115, 116 R

[56] References Cited

U.S. PATENT DOCUMENTS

| | | | |
|---|---|---|---|
| 442,155 | 12/1890 | Virtue | 81/427.5 X |
| 1,284,351 | 11/1918 | Jagielo | 81/427.5 X |
| 2,458,725 | 1/1949 | Periman | 81/427.5 X |
| 2,626,460 | 1/1953 | Wahl . | |
| 2,941,294 | 6/1960 | Vosbikian et al. . | |
| 3,583,264 | 6/1971 | Brunosson | 81/415 |
| 4,304,158 | 12/1981 | Brunosson et al. | 81/427.5 |
| 4,829,858 | 5/1989 | Kern et al. | 81/427.5 X |
| 4,934,222 | 6/1990 | Rittmann et al. | 81/415 X |

FOREIGN PATENT DOCUMENTS

| | | | |
|---|---|---|---|
| 2053071 | 2/1981 | United Kingdom | 81/427.5 |
| 2139545 | 11/1984 | United Kingdom | 16/115 |

*Primary Examiner*—James G. Smith

*Attorney, Agent, or Firm*—Harness, Dickey & Pierce

[57] ABSTRACT

A hand-held tool such as a plier, cutter or the like, having a tool body including pivotally connected basic handles having a preselected arcuately shaped portion, plastic extension members adapted to partially fit over the tool body basic handles and to define therewith an elongated handle subassembly having a desired streamlined shape, and plastic, flexible sheaths located over the elongated handle subassemblies to define a final handle assembly having a desired elongated, streamlined contour with a soft, elastically deformable sheath or covering whereby a lightweight hand-held tool is provided having ergonomically constructed handle assemblies.

28 Claims, 3 Drawing Sheets

ERGONOMIC HANDLE CONSTRUCTION FOR HAND-HELD TOOLS

SUMMARY BACKGROUND OF THE INVENTION

Relates to hand-held tools such as pliers and cutters and more particularly to a unique ergonomically designated handle construction for such tools.

Many industrial tasks require the use of hand-held tools such as pliers, cutters and the like. While these tools are not necessarily large in themselves, the continued use and hand manipulation of these tools in the performance of repetitive motions and tasks can result in fatigue and/or stress to the operator's hand and/or wrist which can lead to a condition referred to as a condition referred to as Cumulative Trauma Disorder ("CTD").

In addressing this problem, a number of factors have to be considered. One factor, of course, is the provision of a construction having a desired mechanical advantage so as to maintain the forces necessary for squeezing or cutting objects to a reasonable level; equally important, however, is a construction providing a generally uniform configuration facilitating gripping by the hand and allowing the gripping pressure to be distributed over the full palm area while permitting an even application of force from all four fingers.

Another factor is the provision of a handle contour which facilitates gripping while still providing an effective shape especially suited to the hand.

Another factor is the provision of a handle construction and design which is sufficiently flexible while still providing adequate strength to withstand the necessary work loads without permanent deformation or breakage. This flexibility acts to absorb the shock loads which would normally be directed to the palms, fingers and wrist when cutting or squeezing various objects.

Yet, another factor is a construction meeting the above objectives while still providing a hand tool which is compact and of a generally light weight.

The above objectives are met in the unique design of the present invention. Here a basic hand tool body is provided with a nose portion comprising conventional cutting blades and/or gripping members which are pivotally connected through handles. This basic structure is constructed of a strong, durable metal which commonly is a high strength ferrous material. The handles can define the typically arcuately bowed shape. In the present invention, however, the handles are elongated by use of extension members made of a flexible plastic material. The extension members are adapted to provide a preselected extension and contour designed to complement the existing handle shape. This will provide an overall, unified shape which comfortably fits the operator's hand; at the same time an increase in mechanical advantage is realized from the increase in handle length. The extension members are generally of a minimum cross-section and hence minimum weight. Next, a generally soft, pliable plastic sheath is placed over each of the extension members. The sheath follows the combined contour of the original handle and associated extension member and hence maintains the desired contour. More importantly, however, the sheath being generally pliable will readily enhance the cushion effect of the handle assembly.

Therefore, it is an object of the present invention to provide a handle assembly for hand-held tools such as pliers, cutters and the like which is of a unique construction for minimizing operator stress and fatigue.

It is still another object of the present invention to provide a unique handle assembly of the above noted type which is of a lightweight construction.

It is a general object to provide a hand-held tool such as that described above having a uniquely constructed handle assembly.

Additional objects, advantages, and features of the present invention will become apparent from the following description and appended claims taken in conjunction with the accompanying drawings.

DETAILED DESCRIPTION OF EMBODIMENT OF THE INVENTION

Figure 1:
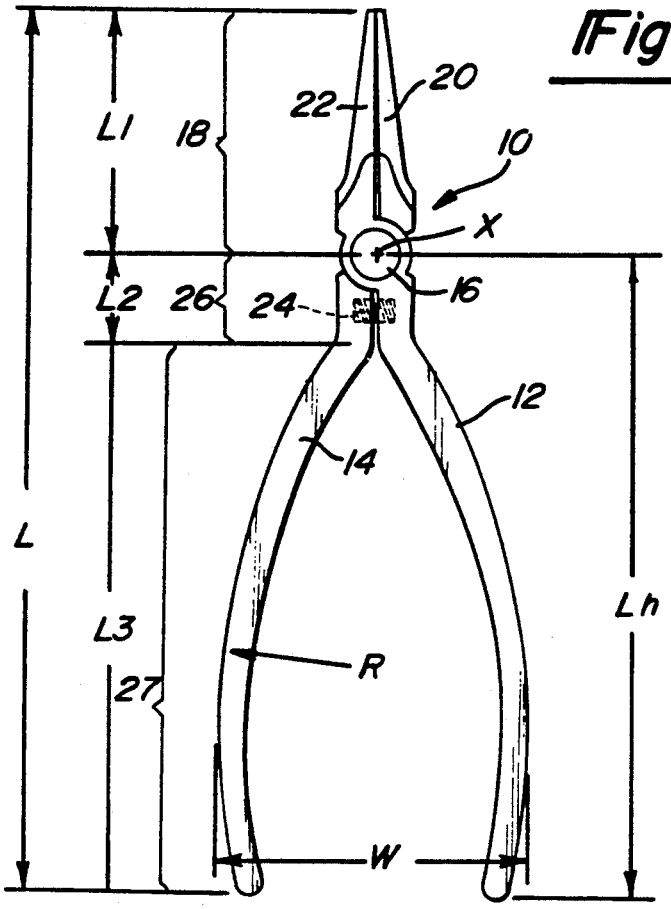
FIG. 1 is a plan view of a plier body prior to application of extension members and sheaths to the basic handles.

Looking now to FIG. 1 of the drawings, a basic plier body 10 is shown which is generally of a conventional construction including basic handles 12 and 14 which are connected to pivot about an axis X by a pivot pin construction 16 of a conventional construction.

A nose portion 18 of the plier body 10 is defined by a pair of elongated gripping sections 20 and 22 which are integrally formed with basic handles 12 and 14, respectively. While the plier body 10 is shown with the nose portion 18 closed, a coil spring 24 partially seated in confronting openings at the inner surfaces at the top of basic handles 12 and 14 normally biases the basic handles 12 and 14 apart such that the nose portion 18 is moved to its fully opened position. The basic handles 12 and 14 and nose portion 18 with associated gripping sections 20, 22 are conventionally made of ferrous materials such as high strength alloy steels.

Figure 7:
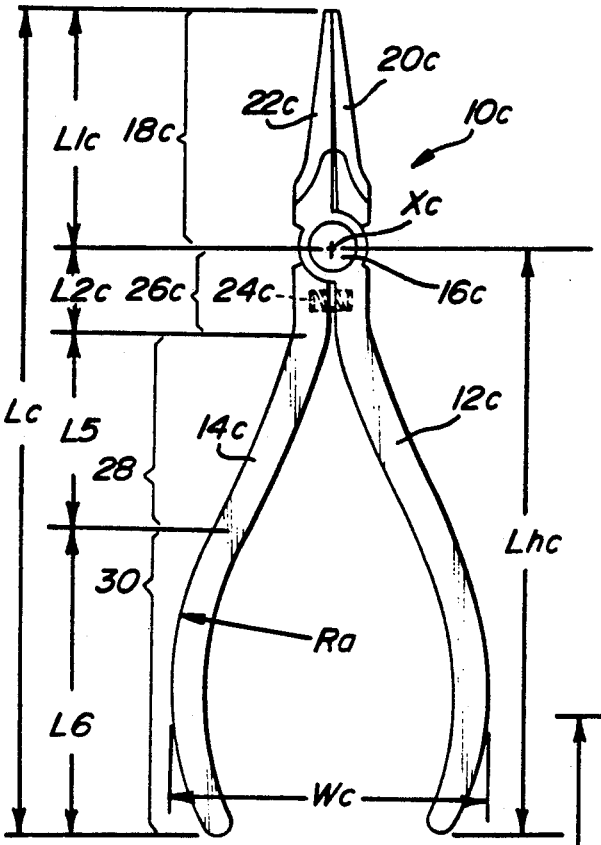
FIG. 7 is a plan view of a modified plier body with basic handles of a different configuration for use with the present invention.
Figure 8:
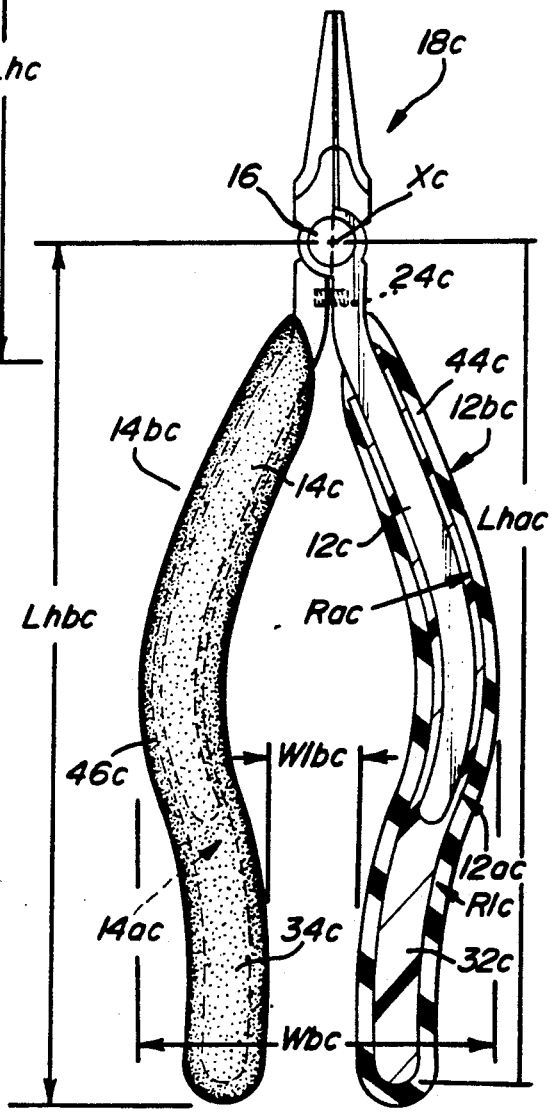
FIG. 8 is a plan view similar to that of FIG. 6 depicting a final plier assembly employing the modified plier body of FIG. 7.

The basic handles 12 and 14 can be of a conventional size and shape. As such, the basic handles 12 and 14 each have a generally straight upper portion 26 and a lower, convexly curved portion 27. In one embodiment, the overall length L of the plier body 10 was approximately 5.06 inches; the length L1 of the nose portion 18, from tip to pivot axis X, was approximately 1.38 inches; the length L2 of the straight upper portion 26 from axis X was approximately 0.50 inches; the length L3 of the curved portion 27 was approximately 3.18 inches. Thus, the overall length Lh of basic handles 12 and 14 from the pivot axis X to the end was approximately 3.68 inches. The lengths of L, L1, L2 and L3 as given above are linear lengths. The radius of curvature R of the outer surface of curved portion 27 was approximately 3.06 inches. When the handles 12, 14 and gripping sections 20, 22 are closed, the maximum width W at the tangent lines of the curved portions 27 is approximately 1.84 inches. It should be noted that the basic handles 12, 14 can be used with different types of pliers, with cutters, etc. At the same time, the curved portion 27 can be a generally continuously curved as shown, arcuate with a varying radius and/or include a generally straight portion such as shown in FIGS. 7 and 8. Thus, while the structure and configuration of the basic handles 12, 14 can be generally similar, the configuration of the nose portion 18 and its length L1 can vary considerably.

Figure 5:
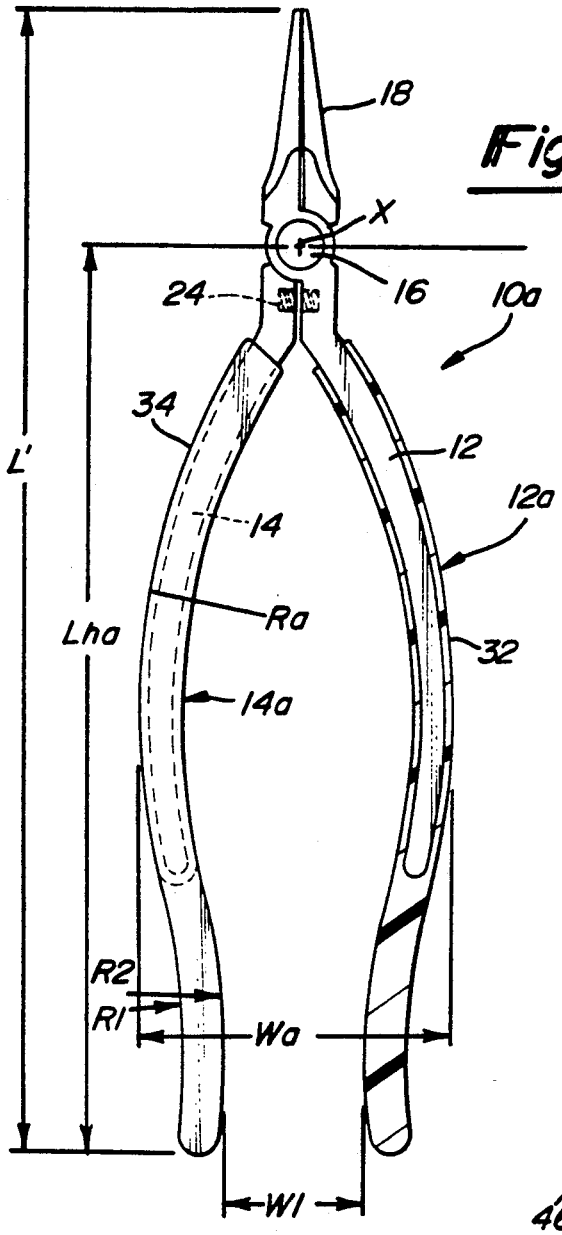
FIG. 5 is a plan view of the plier body of FIG. 1 with extension members, such as shown in FIGS. 2–4, assembled onto each basic handle of the plier body with one of the extension members shown partly broken away.
Figure 6:
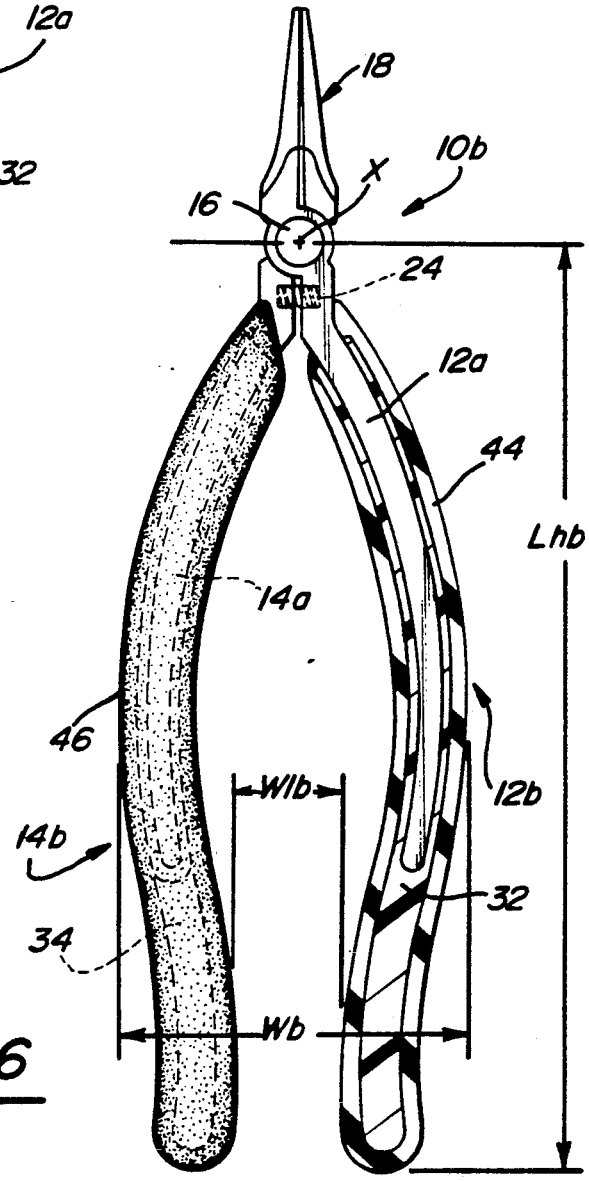
FIG. 6 is a plan view of a final plier assembly depicting the plier body with the basic handles and extension members of FIG. 5 and a pliable plastic sheath assembled over each of the extension members, with one of the extension members and associated sheaths shown partly broken away.

In order to improve the function and overall shape of the basic handles 12 and 14, extension members 32 and 34 are provided not only to lengthen the gripping portion of the basic handles 12 and 14, but also to provide a more desirable contour for matching the operator's hand; see FIG. 5. At the same time, of course, the increased length provides an increase in mechanical advantage.

Figure 2:
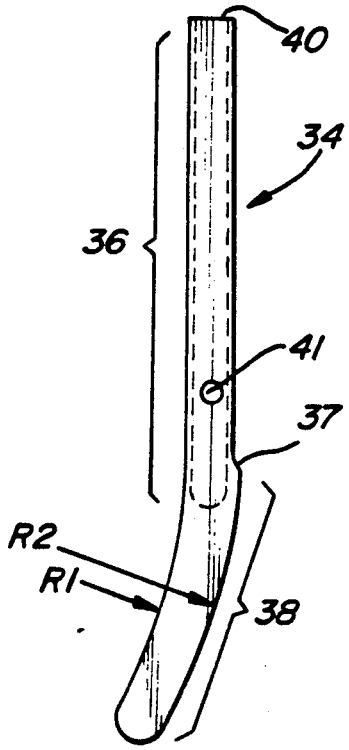
FIG. 2 is a top elevational view of an extension member for use with the basic handles of the plier body of FIG. 1.
Figure 3:
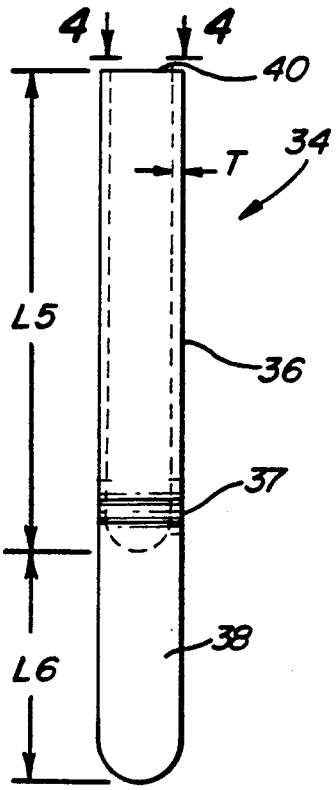
FIG. 3 is a side elevational view of the extension member of FIG. 2.
Figure 4:
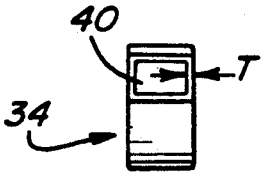
FIG. 4 is an end view of the extension member of FIGS. 2 and 3 taken generally in the direction of arrow 4 in FIGS. 2 and 3.

The extension members 32 and 34 are identical in construction and shape and hence only the extension member 34 is shown and described in detail with respect to FIGS. 2–4. Looking now to FIGS. 2–4, the extension member 34 is illustrated and is of a one piece, molded plastic construction having a generally straight hollow portion 36 of uniform contour and cross-section and a solid curved portion 38. The hollow portion 36 has a transition portion 37 which connects with the solid curved portion 38.

The hollow portion 36 has an open channel 40 which is generally rectangular and matches the shape of basic handle 12 preferably from a close clearance to a slight interference fit. In the form shown, the outside dimensions of the hollow portion 36 were approximately 0.380 inches by 0.250 inches. The length L5 of the hollow portion is approximately 2.8 inches. The linear length L6 of the solid curved portion 38 is approximately 1.33 inches. The radius of curvature R1 of the outer surface of the solid curved portion 38 is approximately 3.01 inches while radius R2 of the inner surface is approximately 2.76 inches. Note that the outer, concave surface of the curved portion 38 will be gripped by the operator.

A vent hole 41 is located near the end of the hollow portion 36 and extends laterally through both side walls and the channel 40. The vent hole 41 provides a means for pressure relief of trapped air and/or liquid adhesive in the channel 40 as the extension member 34 is assembled onto the basic handle 14. Note that the hollow portion 36 as formed is straight, except at the transition portion 37. Because of its reduced cross sectional area caused by the channel 40, the hollow portion 36 will readily deform to follow the variations in contour of the basic handle 14. At the same time, the curved portion 38 is of a solid construction and has the necessary strength to withstand the applied forces while providing flexibility without excessive deflection to generally maintain its original, desired shape. In one form, the extension members 32, 34 can be secured to the basic handles 12, 14 with a liquid adhesive which, prior to setting, acts as a lubricant facilitating assembly of the extension members 32, 34 onto the basic handles 12, 14. As noted, excess adhesive can be evacuated through vent holes 41. In one form of the invention an anaerobic type adhesive was found satisfactory.

FIG. 5 shows plier subassembly **10*a* with the extension members 32, 34 assembled onto the associated basic handles 12, 14 to define elongated handle subassemblies 12*a*, 14*a*. The length Lha of elongated handle subassemblies 12*a*, 14*a*** from the pivot axis X to the lower end is now increased to approximately 5.35 inches with the overall length La being increased to approximately 6.73 inches.

In order to maintain the general contour of the basic handles 12, 14 while keeping the weight added by extension members 32, 34 to a minimum, the thickness T of the sidewalls of the hollow portion 36 was maintained at a minimum and in the embodiment described was approximately 0.050 inches. The result was that the maximum width W of plier body 10 was increased in plier subassembly **10*a*** only slightly to a width Wa of approximately 1.90 inches. At the same time, the minimum inside width W1 was approximately 0.87 inches.

Note that now with the extension members 32, 34 assembled as noted, elongated handle subassemblies **12*a*, 14*a* are now defined by a compound, serpentine curvature of outer surface generally of convex radius Ra of approximately 3.9 inches and an outer surface concave radius Rl of approximately 3.01 inches with both radii flowing smoothly into each other. In one form of the invention, the extension members 32, 34 were of a lightweight plastic material and were manufactured from a polypropylene copolymer manufactured and sold by Eastman Chemical Products, Inc. under the trade designation Tenite Polypropylene PSM4T-013. It should be noted then that the extension members 32, 34 add minimal weight in comparison to forming the handle subassemblies 12*a* or 14*a*** completely from steel.

In order to provide a soft, resilient grip and feel to the elongated handle subassemblies **12*a* and 14*a*, a pliable sheath 44, 46 is provided to cover each handle subassembly 12*a*, 14*a* resulting in the final plier assembly 10*b* having handle assemblies 12*b*, 14*b*. The sheaths 44, 46 are made of a flexible, pliable plastic material such as an expanded vinyl or flexible foam material. Thus, the sheaths 44, 46 will readily resiliently deform to cushion the operator's hand. Note that in the form shown, the sheaths 44, 46** had a generally uniform wall thickness of approximately 0.06 inches. It should be understood that pliable sheaths and generally hard plastic covers have previously been used on metallic handles for hand-held tools such as pliers and cutters.

At the same time, the hollow portions of extension members 32, 34 are adapted fit over the basic handles 12, 14 to substantially cover the entire portion to be gripped thus avoiding any discontinuities in the gripping surface which could also cause pressure points on the palm of the operator's hand. The overall final length Lhb of the handle assemblies **12*b*, 14*b* is around 5.41 inches which is sufficient to extend substantially across the palm of the operator's hand without a pressure point on the palm from the end of the handle assemblies 12*b*, 14*b*. Thus, the handle assemblies 12*b*, 14*b*** are now of an overall length Lhb and serpentine shape to provide good load and gripping distribution over the operator's hand. It is believed desirable that the overall handle length Lhb be at least around five inches. At the same time the maximum closed width Wb was around 2.02 inches while the minimum width Wlb was around 0.75 inches.

The extension members 32, 34 each weighed around 0.013 ounces, while the sheaths 44, 46 each weighed around 0.016 ounces. At the same time, the nose portion 18 of base plier body 10 (i.e. overall length L1) weighed around 0.320 ounces with the weight of each of the basic handles 12, 14 (i.e. overall length Lh) being approximately 0.848 ounces; (the total weight of handle assemblies **12*b*, 14*b* over length Lhb being around 1.754 ounces). Thus, it can be seen that the extension members 32, 34 and sheaths 44, 46 while providing the desired contour, additional length and flexibility contributed a total of only 0.058 ounces to the overall weight of the basic handle assemblies 12*b*, 14*b* and of the plier assembly 10*b*. By contrast, had the extension members 32, 34 been made of steel, the weight added to each of the handles 12, 14** would have been around 0.304 ounces with the total added weight with steel extensions being around 0.620 ounces. Thus the desired contour with the present invention is provided with a lightweight construction with the added weight being less than one fourth that which would be added if extensions of steel were used.

It is believed desirable that the lengths Lh and Lhc of basic handles 12, 14 and **12*c*, 14*c* be in the range of from around 2.75 inches to around 3.75 inches, the lengths Lha and Lhac of the handle subassemblies 12*a*, 14*a* and 12*ac*, 14*ac*** be in the range of from around 4.4 inches to around 5.4 inches and that the lengths Lhb and Lhbc be in the range of from around 4.5 inches to around 5.5 inches.

Thus while the present invention has been described with regard to a plier construction, it should be understood that the unique features of the invention are equally applicable to other types of hand-held tools such as, for example, various cutters and other types of pliers. In this regard, as previously noted, the shape and length of nose portion 18 could be altered for different pliers and cutters. At the same time, extension members, such as 32, 34, and/or sheaths, such as 44, 46 could be applied and/or modified as a retrofit to hand tools already in the field. It should also be noted that the specific dimensions given for the various portions of the embodiment shown and described are by way of example and the disclosure of dimensions to two places after the decimal point (e.g. R1=3.01 inches) does not signify the need for extreme tolerance limits.

FIGS. 7 and 8 depict a plier body with modified basic handles for use with the extension members and sheaths as previously shown and described. In the description of the embodiment of FIGS. 7 and 8 components similar to like components in the embodiment of FIGS. 1–6 will be given the same numeral or letter designation with the addition of the letter postscript "c".

Looking now to FIG. 7 of the drawings, plier body **10*c* is generally of a conventional construction and includes basic handles 12*c* and 14*c* which are connected to pivot about an axis Xc by pivot pin construction 16*c***.

Nose portion **18*c* of the plier body 10*c* includes gripping sections 20*c* and 22*c***.

The basic handles **12*c* and 14*c* each have a generally straight upper portion 26*c*, an intermediate angled portion 28 and a lower, convexly curved portion 30. In the embodiment of FIG. 7, the lengths of L1*c* and L2*c* are the same as L1 and L2 of FIG. 1. The length L5 of the intermediate angled portion 28 was approximately 1.30 inches; and the length L6 of the curved lower portion 30 was approximately 1.68 inches. The radius of curvature Rc of the outer surface of curved portion 30 was approximately 3.06 inches. The maximum width Wc at the tangent lines of the curved portions 30 was approximately 1.84 inches. Thus the overall length Lc of the plier body 10*c* was approximately 4.86 inches and the overall length Lhc of the basic handles 12*c*, 14*c*** from the pivot axis $X_c$ to the end was approximately 3.48 inches.

Looking now to FIG. 8, the plier body **10*c* is shown in a final plier assembly 10*bc* and includes extension members 32*c* and 34*c* which are identical in construction and shape to the extension members 32, 34** as previously described. Thus it should be noted that the same extension construction is generally readily adaptable to fit different basic handle designs.

It can be seen that with the extension members **32*c*, 34*c* assembled onto the basic handles 12*c*, 14*c* elongated handle subassemblies 12*ac*, 14*ac* are defined by a compound, serpentine curvature of outer surface generally of convex radius Rac of approximately 3.09 inches and an outer surface concave radius R1c of approximately 3.01 inches with both radii flowing smoothly into each other. Thus the overall length Lhac of the handle subassemblies 12*ac*, 14*ac*** from pivot axis Xc to the end was approximately 5.15 inches.

At the same time sheaths **44*c*, 46*c* are identical to sheaths 44, 46 and also are readily adaptable to the modified basic handles 12*c*, 14*c* with extension members 32*c*, 34*c***.

The overall final length Lhbc of the handle assemblies **12*bc*, 14*bc* from pivot axis X to the end is of around 5.21 inches which is sufficient to extend substantially across the palm of the operator's hand without a pressure point on the palm from the end of the handle assemblies 12*bc*, 14*bc*. With the sheaths 44*c*, 46*c*, the final plier assembly 10*bc* has handle assemblies 12*bc*, 14*bc*** which are of an overall length and serpentine shape to provide good load and gripping distribution over the operator's hand. The maximum width Wbc and minimum width Wlbc are generally the same as widths Wb and Wlb, respectively.

The weights of the various elements of the embodiment of FIGS. 7 and 8 are generally the same as those described for similar elements in the embodiment of FIGS. 1–6. Thus with both structures a final assembly is provided which is lightweight and has the good load and gripping distribution advantage noted.

It is believed desirable that the lengths Lh and Lhc of basic handles 12, 14 and **12*c*, 14*c* be in the range of from around 2.75 inches to around 3.75 inches, the lengths Lha and Lhac of the handle subassemblies 12*a*, 14*a* and 12*ac*, 14*ac*** be in the range of from around 4.4 inches to around 5.4 inches and that the lengths Lhb and Lhbc be in the range of from around 4.5 inches to around 5.5 inches.

The hand tools shown and described are of a type referred to as "electronic hand tools". While the features of the present invention are particularly applicable to electronic hand tools it is believed that these features may be advantageous to other hand tools as well. Thus while it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. A hand-held tool comprising:

a tool body having a pair of elongated basic handles pivotably connected at their upper ends to pivot about a pivot axis, at least a portion of the lower ends of said basic handles having outer surfaces of an arcuate, convexly curved contour, said tool body including a nose portion defined by a pair of work members connected with and extending from said upper ends of said basic handles, said work members adapted to engage a workpiece, a pair of extension members, each of said extension members having a hollow portion adapted to receive at least a portion of said lower ends of said basic handles with a generally snug fit, said hollow portion being of a minimal wall thickness whereby it will generally adopt the contour of the portion of said lower ends which it overengages, said extension members having a substantially solid portion extending from said lower ends of said basic handles, said solid portions having an arcuate concave contour whereby a generally serpentine contour is defined by the combination of said hollow portion contour following the convex contour of said lower ends of said basic handles and said concave solid portion, a soft flexible sheath covering each of said extension members to define a final handle assembly adapted to be gripped by the operator and selectively manipulated to pivot the handle members about said axis to selectively engage the workpiece with said work members.

2. The hand-held tool of claim 1 with said associated convex contour of said basic handles being generally defined by a radius of around three inches at the outer surface, and said arcuate concave contour of said solid portions being generally defined by a radius of around three inches at the outer surface.

3. The hand-held tool of claim 1 with the linear distance from said pivot axis to the end of said solid portions being at least around five inches.

4. The hand-held tool of claim 1 with said associated convex contour of said basic handles being generally defined by a radius of around three inches at the outer surface, and said arcuate concave contour of said solid portions being generally defined by a radius of around three inches at the outer surface, the linear distance from said pivot axis to the end of said solid portions being at least around five inches.

5. The hand-held tool of claim 1 with said basic handles and nose portion of said tool body being made of a ferrous material and with said extension members being made of a lightweight plastic.

6. The hand-held tool of claim 1 with said basic handles and nose portion of said tool body being made of a ferrous material and with said extension members being made of a lightweight plastic, said extension members each having a weight generally no greater than around 0.013 ounces.

7. The hand-held tool of claim 1 with said basic handles and nose portion of said tool body being made of a ferrous material and with said extension members being made of a lightweight plastic, said extension members each having a weight generally no greater than around 0.013 ounces, said soft flexible sheaths each having a weight generally no greater than around 0.016 ounces.

8. The hand-held tool of claim 1 with said basic handles and nose portion of said tool body being made of a ferrous material and with said extension members being made of a lightweight plastic, said hollow portion of each of said extension members being defined by a generally continuous wall having a thickness generally no greater than around 0.050 inches.

9. The hand-held tool of claim 1 with said basic handles and nose portion of said tool body being made of a ferrous material and with said extension members being made of a lightweight plastic, said hollow portion of each of said extension members being defined by a generally continuous wall having a thickness generally no greater than around 0.050 inches, said extension members being secured to said basic handles with a liquid adhesive with said hollow portions having a vent opening proximate to said solid portions to facilitate evacuation of air and excess liquid adhesive during installation.

10. The hand-held tool of claim 1 with said basic handles and nose portion of said tool body being made of a ferrous material and with said extension members being made of a lightweight plastic, said hollow portions being of an overall length to receive substantially the full length of said basic handles which is to be gripped by the operator.

11. A hand-held tool comprising:

a tool body having a pair of elongated basic handles pivotably connected at their upper ends to pivot about a pivot axis, at least a portion of the lower ends of said basic handles having outer surfaces of an arcuate, convexly curved contour, said tool body including a nose portion defined by a pair of work members connected with and extending from said upper ends of said basic handles, said work members adapted to engage a workpiece, a pair of extension members, each of said extension members having a hollow portion adapted to receive at least a portion of said lower ends of said basic handles with a generally snug fit, said hollow portion being of a minimal wall thickness whereby it will generally adopt the contour of the portion of said lower ends which it overengages, said extension members having a substantially solid portion extending from said lower ends of said basic handles, said solid portions having an arcuate concave contour whereby a generally serpentine contour is defined by the combination of said hollow portion contour following the convex contour of said lower ends of said basic handles and said concave solid portion, a soft flexible sheath covering each of said extension members to define a final handle assembly adapted to be gripped by the operator and selectively manipulated to pivot the handle members about said axis to selectively engage the workpiece with said work members, said basic handles each having a linear length from said pivot axis to its free end in the range of from around 3.25 inches to around 3.75 inches, said basic handles with said extension members secured thereto defining handle subassemblies with each having a linear length from said pivot axis to its free end in the range of from around 4.4 inches to around 5.4 inches, said handle subassemblies with said sheaths secured thereto defining handle assemblies with each having a linear length from said pivot axis to its free end in the range of from around 4.5 inches to around 5.5 inches.

12. The hand-held tool of claim 11 with said associated convex contour of said basic handles being generally defined by a radius of around three inches at the outer surface, and said arcuate concave contour of said solid portions being generally defined by a radius of around three inches at the outer surface.

13. The hand-held tool of claim 11 with said basic handles and nose portion of said tool body being made of a ferrous material and with said extension members being made of a lightweight plastic.

14. The hand-held tool of claim 11 with said basic handles and nose portion of said tool body being made of a ferrous material and with said extension members being made of a lightweight plastic, said extension members each having a weight generally no greater than around 0.013 ounces.

15. The hand-held tool of claim 11 with said basic handles and nose portion of said tool body being made of a ferrous material and with said extension members being made of a lightweight plastic, said extension members each having a weight generally no greater than around 0.013 ounces, said soft flexible sheaths each having a weight generally no greater than around 0.016 ounces.

16. The hand-held tool of claim 11 with said basic handles and nose portion of said tool body being made of a ferrous material and with said extension members being made of a lightweight plastic, said hollow portion of each of said extension members being defined by a generally continuous wall having a thickness generally no greater than around 0.050 inches.

17. The hand-held tool of claim 11 with said basic handles and nose portion of said tool body being made of a ferrous material and with said extension members being made of a lightweight plastic, said hollow portion of each of said extension members being defined by a generally continuous wall having a thickness generally no greater than around 0.050 inches, said extension members being secured to said basic handles with a liquid adhesive with said hollow portions having a vent opening proximate to said solid portions to facilitate evacuation of air and excess liquid adhesive during installation.

18. The hand-held tool of claim 11 with said basic handles and nose portion of said tool body being made of a ferrous material and with said extension members being made of a lightweight plastic, said hollow portions being of an overall length to receive substantially the full length of said basic handles which is to be gripped by the operator.

19. A hand-held tool comprising:

a tool body having a pair of elongated basic handles pivotably connected at their upper ends to pivot about a pivot axis, at least a portion of the lower ends of said basic handles having outer surfaces of an arcuate, convexly curved contour, said tool body including a nose portion defined by a pair of work members connected with and extending from said upper ends of said basic handles, said work members adapted to engage a workpiece, a pair of extension members, each of said extension members having a hollow portion adapted to receive at least a portion of the lower end of the associated one of said basic handles with a generally snug fit, said hollow portion being of a minimal wall thickness whereby it will generally adopt the contour of the portion of said lower end which it overengages, each of said extension members having a substantially solid portion extending from the associated one of said lower ends of said basic handles, said solid portions having an arcuate concave contour whereby a generally serpentine contour is defined by the combination of said hollow portion contour following the convex contour of said lower ends of said basic handles and said concave solid portion.

20. A hand-held tool comprising:

a tool body having a pair of elongated basic handles pivotably connected at their upper ends to pivot about a pivot axis, at least a portion of the lower ends of said basic handles having outer surfaces of an arcuate, convexly curved contour, said tool body including a nose portion defined by a pair of work members connected with and extending from said upper ends of said basic handles, said work members adapted to engage a workpiece, a pair of extension members, each of said extension members having a hollow portion adapted to receive at least a portion of the associated one of said lower ends of said basic handles with a generally snug fit, said hollow portion being of a minimal wall thickness whereby it will generally adopt the contour of the portion of said lower ends which it overengages, said extension members having a substantially solid portion extending from said lower ends of said basic handles, said solid portions having an arcuate concave contour whereby a generally serpentine contour is defined by the combination of said hollow portion contour following the convex contour of the associated one of said lower ends of said basic handles and said concave solid portion, said basic handles each having a linear length from said pivot axis to its free end in the range of from around 3.25 inches to around 3.75 inches, said basic handles with said extension members secured thereto defining handle subassemblies with each having a linear length from said pivot axis to its free end in the range of from around 4.4 inches to around 5.5 inches.

21. The hand-held tool of claim 20 with said basic handles and nose portion of said tool body being made of a ferrous material and with said extension members being made of a lightweight plastic, said hollow portion of each of said extension members being defined by a generally continuous wall having a thickness generally no greater than around 0.050 inches.

22. The hand-held tool of claim 20 with said basic handles and nose portion of said tool body being made of a ferrous material and with said extension members being made of a lightweight plastic, said hollow portion of each of said extension members being defined by a generally continuous wall having a thickness generally no greater than around 0.050 inches, said extension members being secured to said basic handles with a liquid adhesive with said hollow portions having a vent opening proximate to said solid portions to facilitate evacuation of air and excess liquid adhesive during installation.

23. In a hand-held tool having:

a tool body having a pair of elongated basic handles pivotably connected at their upper ends to pivot about a pivot axis, at least a portion of the lower ends of said basic handles having outer surfaces of an arcuate, convexly curved contour, said tool body including a nose portion defined by a pair of work members connected with and extending from said upper ends of said basic handles, said work members adapted to engage a workpiece, the improvement comprising:

a pair of extension members, each of said extension members having a hollow portion adapted to receive at least a portion of an associated one of said lower ends of said basic handles with a generally snug fit, said hollow portion being of a minimal wall thickness whereby it will generally adopt the contour of the portion of the associated one of said lower ends which it overengages, said extension members each having a substantially solid portion extending from the associated one of said lower ends of said basic handles, said solid portions each having an arcuate concave contour whereby a generally serpentine contour is defined by the combination of said hollow portion contour following the convex contour of the associated one of said lower ends of said basic handles and said concave solid portion.

24. The hand-held tool of claim 23 with said arcuate concave contour of said solid portions being generally defined by a radius of around three inches at the outer surface.

25. The hand-held tool of claim 23 with the basic handles with said extension members secured thereto having a linear distance from said pivot axis to the end of said solid portions being at least around five inches.

26. The hand held tool of claim 23 with the basic handles with said extension members secured thereto defining handle subassemblies with each having a linear length from said pivot axis to its free end in the range of from around 4.4 inches to around 5.4 inches.

27. The hand-held tool of claim 23 with the basic handles and nose portion of said tool body being made of a ferrous material and with said extension members being made of a lightweight plastic, said hollow portion of each of said extension members being defined by a generally continuous wall having a thickness generally no greater than around 0.050 inches.

28. The hand-held tool of claim 23 with said basic handles and nose portion of said tool body being made of a ferrous material and with said extension members being made of a lightweight plastic, said hollow portion of each of said extension members being defined by a generally continuous wall having a thickness generally no greater than around 0.050 inches, said extension members being secured to said basic handles with a liquid adhesive with each of said hollow portions having a vent opening proximate to said solid portion to facilitate evacuation of air and excess liquid adhesive during installation.

* * * * *